US005394709A

United States Patent [19]

Lorentzen

[11] Patent Number: 5,394,709

[45] Date of Patent: Mar. 7, 1995

[54] THERMODYNAMIC SYSTEMS INCLUDING GEAR TYPE MACHINES FOR COMPRESSION OR EXPANSION OF GASES AND VAPORS

[75] Inventor: Gustav Lorentzen, Trondheim, Norway

[73] Assignee: Sinvent A/S, Trondheim, Norway

[21] Appl. No.: 108,657

[22] PCT Filed: Dec. 16, 1993

[86] PCT No.: PCT/NO92/00036

§ 371 Date: Nov. 17, 1993

§ 102(e) Date: Nov. 17, 1993

[87] PCT Pub. No.: WO92/15774

PCT Pub. Date: Sep. 17, 1992

[30] Foreign Application Priority Data

Mar. 1, 1991 [NO] Norway ..... 910827

[51] Int. Cl.[6] ..... F25D 9/00

[52] U.S. Cl. ..... 62/402; 62/510

[58] Field of Search ..... 62/402, 510

[56] References Cited

U.S. PATENT DOCUMENTS 3,848,422 11/1974 Schibbye .
4,149,585 4/1979 Sterlini .
4,311,021 1/1982 Leo ..... 62/402
4,967,565 11/1990 Thompson et al. ..... 62/402
5,014,518 5/1991 Thompson et al. ..... 62/402

FOREIGN PATENT DOCUMENTS 660528 7/1929 France .
1243816 7/1967 Germany .
123960 1/1977 Germany .
3613734 10/1987 Germany .
1237327 6/1971 United Kingdom .

OTHER PUBLICATIONS

"Verdichter", Technisches Handbuch, 1966, Böhm et al.

*Primary Examiner*—Ronald C. Capossela
*Attorney, Agent, or Firm*—Wenderoth, Lind & Ponack

[57] ABSTRACT

Actual thermodynamic processes occurring in a system such as a heat pump or refrigeration plant are made to approach theoretical ideal processes, e.g. an isothermal ($T_o$), by use of a multistage gear machine as compressor and/or expander in the system, and conditioning, such as cooling, the system working fluid between successive stages in the machine. The individual stages of the gear machine each include a pair of meshing gears, preferably cylindrical spur gears of equal diameter and diminishing width from stage-to-stage.

13 Claims, 9 Drawing Sheets

THERMODYNAMIC SYSTEMS INCLUDING GEAR TYPE MACHINES FOR COMPRESSION OR EXPANSION OF GASES AND VAPORS

BACKGROUND OF THE INVENTION

Conventional gas compressors and expanders are often classified in two groups corresponding to the principle of pressure change, i.e. static or dynamic action machines. They all have in common that the pressure change takes place more or less adiabatically, i.e. with relatively little exchange of heat with the surroundings, since the surface available for heat transfer during the process is much too small to allow any appreciable deviation from this regime. This causes a loss of power compared with a theoretical isothermal process.

Theoretical explanations how such power losses can be reduced by making the process of an essentially adiabatic compressor approach the isotherm by staging and intercooling will be found in almost any elementary text book on thermodynamics, e.g. in the book entitled "Technisches Handbuch Verdichter" third addition, p. 42–43. Usually, however, the problem is to find a practical and economical way of performing such processes.

One common design of a static or positive displacement machine is the reciprocating or rotating piston compressor. These types are normally used in a single stage up to a ratio of discharge to suction pressure of 6–8 and some times even higher, depending on the properties of the gas to be pumped and other working conditions. Consequently the adiabatic loss becomes quite important. Only at very high overall pressure ratios will a machine with two or more stages be used since this is an expensive solution. The power saving at moderate pressure ratio is not sufficient to pay for this more complicated design.

Another popular positive displacement type of compressor/expander is the screw machine. Its operational properties are similar to those of a piston machine, although there is a tendency to use it at even higher pressure ratios in a single stage.

Turbo machines operate on the dynamic principle, converting high flow velocities into pressure, and are used extensively for large flow volumes. Although the pressure ratio per stage is limited, in particular for compressors, intercooling, or heating between stages is rarely done. Due to the particular design conditions of such machines it would be too complicated and expensive to provide for bringing the gas out and back again for each stage. Only in the case of very nigh overall pressure ratios, when some intercooling or heating is unavoidable, is this done by using two or more machines in series, each containing a fair number of stages, and executing the heat exchange in transferring the gas from one unit to the next. The adiabatic power loss becomes at least as large as for the common positive displacement machines.

Gear type machines are extensively employed as pumps and motors in hydraulic power systems. With a nearly incompressible liquid working medium, normally oil, they can operate with very high efficiency at extreme pressure ratios. Sometimes similar machines are used as expanders in pneumatic systems for the operation of small power tools or starting of internal combustion engines. In such cases, with single stage operation and relatively large pressure ratio, the power efficiency becomes very poor.

A somewhat similar design, the "Roots blower", is sometimes used as a compressor for low pressure ratios. The common type uses two lobes, but three or up to four lobes are also found. Since the rotors are not fit to transmit power, they have to be synchronized by a separate set of gears. Two or three pairs of rotors are some times used in series in order to increase the pressure.

It has been proposed to use multistage gear or Roots machines for the expansion or compression in open systems, i.e. systems open to the atmosphere. Some patents pertaining to such applications can be referred to:

- German patent DE 3,613,734 A1 (H. Bindert) describes a gear type machine to be used as an internal combustion motor with expansion of the exhaust gas through one or several stages of a gear expander with increasing flow volume.
- DDR patent 123,960 (A. Bäuml) concerns a multistage gear or rather Roots type compressor, where all the stages are equal in design and volume capacity, sucking in air in parallel from the atmosphere at the same pressure. The discharge from one stage is delivered to the next and injected into the void-space between the rotor lobes in passage between the suction and discharge openings, thereby increasing the pressure approximately in arithmetic sequence (2× in the second stage, 3× in the third stage . . . ). This leads to excessive pressure differences in the later stages.
- French patent 660.528 covers a multistage Roots type compressor with up to four stages with diminishing volume capacity by reduction of the width of the rotors from one stage to the next. The machine is equipped with a water jacket, which can obviously provide only a very limited cooling of the gas during compression. For a large pressure increase it is foreseen to use two or more machines in series in the usual way.
- German patent 1,243,816 (Leybold) describes a Roots type vacuum pump with at least two stages, where the low pressure stage is placed in the middle between two parts of a later stage, which has been divided for this purpose. The object of this arrangement is to avoid the entry of lubricating oil into the low pressure stage.
- German patent 1,903,297 (A. Bäder) concerns a gear pump primarily for lubricating oil with two parallel rotors, which can be driven with different speed of revolution. The purpose of this arrangement is to regulate the rate of flow.

None of the systems described have any provision for interstage heat exchange or other arrangements to adapt them to the generation of a desirable thermodynamic cycle.

The main purpose of the present invention is to permit designing thermodynamic systems to approach any desired theoretical cycle of pressure and temperature variation. Currently available equipment suffers from considerable restrictions and lack of flexibility in this respect:

- Compression and expansion have to be nearly adiabatic over quite large increments of pressure.
- Although gliding temperature heat exchange can be realized either by using gases which are non-condensible in the actual range (Joule or Brayton cycle) or zeotropic mixtures of condensible fluids, both of these solutions present strong restrictions in the choice of temperature curves. There are bindings leading to mismatch in the heat exchangers.

Similarly, when a trans-critical process is used to generate near constant temperature in the low side heat transfer with phase change and a continuous temperature glide at the high side, a satisfactory match is difficult to achieve.

A prior heat pump system that to a certain extent may alleviate the above deficiencies is described in SE-A-432 145. There is no suggestion, however, in that document as to what kind of machinery should be adopted for the compression processes described therein, except in the drawings which seem to indicate some kind of turbo-machinery. However, as noted above, turbo-machines are too complicated and expensive to permit realization of the above purpose of the present invention in a practical and economical manner.

SUMMARY OF THE INVENTION

According to the present invention these difficulties inherent of the prior art are eliminated or at least substantially reduced, and the above purpose is achieved by employing multistage gear compressors and expanders in combination with interstage heat exchangers including evaporators and condensors. Other equipment such as liquid separators, mass exchangers, throttling devices, etc., may be added as appropriate.

A gear machine which lends itself to a design with many stages and smaller pressure increments, without much penalty in extra cost, can serve to relieve many of the normal restrictions.

By a multistage "gear machine" is meant a machine in which pairs of meshing gears, e.g. like those of a gear pump, are utilized to compress or expand a working fluid flowing through the machine. Also machines of the above discussed Roots type, having not more than two teeth per gear are contemplated for the systems of the present invention. However, gears of the ordinary hydraulic pump type, having at least seven teeth, are much preferred.

Another advantage of many compression or expansion stages and correspondingly small pressure increments is that internal leakage in the machine is reduced to a minimum without extreme demands on the design. The entire aggregate has the character of a labyrinth seal. Also, since the machine is completely balanced and can be built with large inlet and outlet gates, it lends itself to operation at high speed. This favours compact design and moderate cost.

A special benefit of a gear machine is its complete insensitivity to liquid slugging. It is therefore problem-free to employ it for compression and expansion of gas/liquid mixtures or even pure liquids.

BRIEF DESCRIPTION OF THE DRAWINGS

Further objects and advantages of the invention will appear from the following description of various embodiments thereof, with reference to the drawings in which.

DETAILED DESCRIPTION OF THE INVENTION

Figure 1:
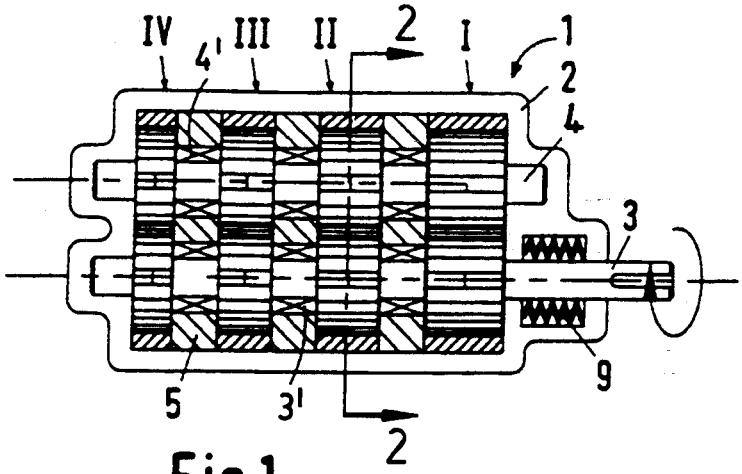
FIG. 1 is a schematic longitudinal section through a preferred embodiment of a multistage gear machine according to the invention.
Figure 2:
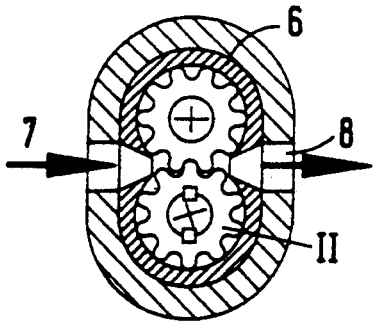
FIG. 2 is a cross-section taken on line 2—2 in FIG. 1.

The multistage gear machine 1 shown in FIGS. 1 and 2 is described as a compressor below, but it may also be used as an expander per one of the examples to follow. Machine 1 is generally comprised of a casing 2 in which a series of pairs of mating, cylindrical spur gears are supported. In the example shown there are four pairs, designated I, II, III and IV respectively, each of which constitutes a stage of the compressor 1, "I" representing the lowest pressure stage and "IV" the highest one. One of the gears of each pair I–IV is mounted on a common drive shaft 3, while the other gear of each pair is mounted on a common, idle shaft 4 driven via the gear transmission. Shafts 3 and 4 are supported in bearings 3', 4' respectively. Stages I–IV are separated by partition walls 5 forming, together with circumferential walls 6 encircling the gears, a chamber having inlet and outlet ports or gates 7 and 8 respectively for each pair of gears, and having the least possible clearance thereto without preventing rotation of the gears. The partition walls 5 may be provided with circumferential seals (not shown) engaging the gear lateral surfaces for sealing between the individual stages, and a shaft seal 9 prevents gas leaking from stage I to the exterior.

As appearing from FIG. 1 and 2 the gear pairs are arranged in a relationship of successively reduced transport volume, or in other words in a manner such that the volume rate of flow of the gas to be compressed is successively reduced from stage to stage during the compression process.

In the embodiment of the multistage gear compressor 1 according to the invention this is achieved by using gears having the same diameter in all stages and gradually reduced width from the first to the last stage, such as shown in FIG. 1. This results in a simple and economic structure. However, the same effect could be achieved in another way, such as by equal gear width and gradually reduced diameter.

The gear pairs I–IV may be formed in any practical manner and from any convenient material known to persons skilled in the art, e.g. such as those used in conventional hydraulic gear pumps. Various modifications to provide deviations from ordinary tooth profiles may be made, in order to obtain a higher efficiency and reduced pressure pulses and noise. The gears may also be formed from self-lubricating plastics or sintered materials. The number of teeth on each gear would be selected from considerations of the required flow rate capacity of the machine and should preferably be as few as convenient while ensuring a problem-free power transmission. Normally from seven to twenty teeth would be used.

Figure 3:
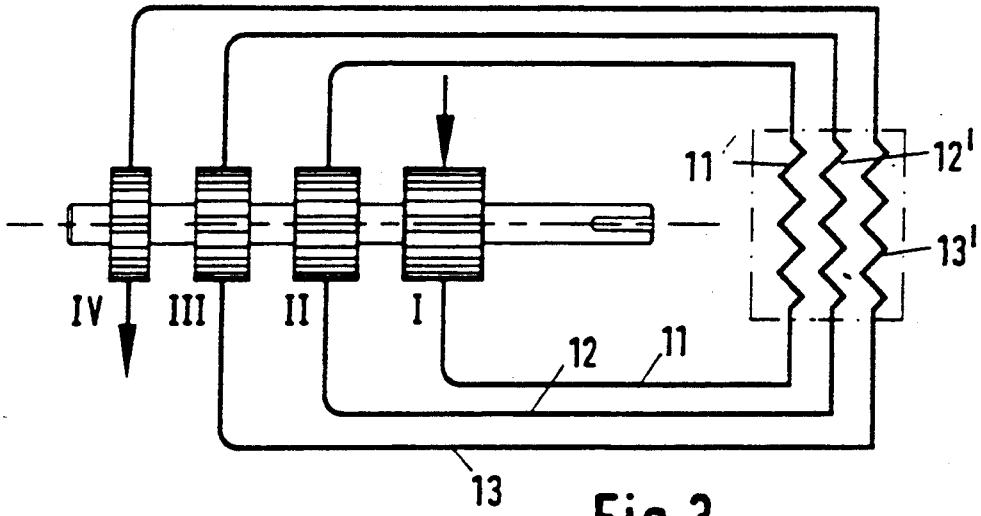
FIG. 3 is a flow diagram illustrating the gas flow through the machine shown in FIG. 1.

As schematically indicated in the flow diagram shown in FIG. 3, the gas to be compressed, e.g. air at atmospheric pressure $P_0$ and temperature $T_0$, upon being compressed to pressure $P_1$ and temperature $T_1$ in the first stage I, is directed in series through passages or conduits 11, 12, 13 including gas conditioning means 11', 12', 13', such as heat exchangers, to cause intercooling between the subsequent stages II–IV. Preferably, according to the invention such intercooling would take place in a manner so as to bring the gas which, owing to the compression process, has a temperature at the exit of each stage higher than the initial temperature $T_0$, back to the latter temperature $T_0$ during the cooling process before entering the subsequent stage. This is indicated in the PV chart, FIG. 4, in which the curve $T_0$ represents the isothermal for this temperature.

As is well-known, an "ideal" compression process involving the least possible loss of energy will follow an isotherm, which is a theoretical process not easily realized in practice. Through the above described process using the multistage gear machine according to the invention there will be no volume displacement between the two profiles within the individual stages while passing from the lower to the higher pressure, and the compression takes place by back flow from the pressure side when the tooth space opens to the latter. No gas displacement occurs until the tooth profiles engage upon leaving the pressure space, which results in an energy loss. In the FIG. 4 diagram this loss is represented by the area of the shaded triangles above the isotherm $T_0$. It is evident from that diagram that by using a sufficient number of stages and intercooling, this loss could be made as small as desirable. In practice the pressure ratio across each stage should not be higher than 2, for example, which normally would imply a corresponding ratio between the transport volume of the individual stages, i.e. between the width of any adjacent pair of gears in the example described above and shown in FIGS. 1–2.

Figure 4:
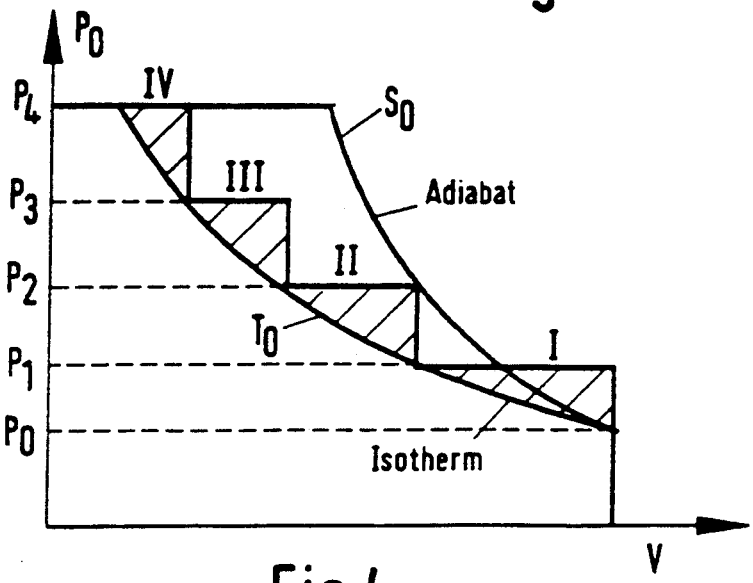
FIG. 4 is a PV diagram indicating the theoretical compression curve when using the multistage gear compression machine as shown in FIG. 1 and when using a conventional adiabatic single stage compressor for the same pressure ratio.

For comparison, the diagram of FIG. 4 also indicates the theoretical compression curve $S_0$ (constant-entropy) for a typical adiabatic single stage compressor working with the same pressure ratio. As shown, the curve $S_0$ deviates more from the isotherm $T_0$ the higher the pressure ratio. By using a multistage gear compressor and cooling the gas between the stages, the isothermal curve $T_0$ can be approached and the power consumption reduced, in spite of the fact that the gear machine has a generic loss due to the lack of volume displacement between suction and discharge openings. Thus, the energy gained by using a multistage gear compressor according to the invention is represented by the unshaded area between the adiabatic curve $S_0$ and the "step-wise" curve I–IV above the isothermal curve $T_0$ with the deduction of the shaded area above the adiabat.

Naturally the same theoretical energy gain would be obtained by using a conventional compressor having several stages as well. However, a such multistage type of conventional compressor would have to be large and expensive and rather unpractical.

The crux of the invention lies in the recognition of the fact that actual thermodynamical processes, such as in heat pumps, refrigeration systems, etc, can be made to approach the corresponding theoretical or "ideal" processes, in an economical and practical manner, by incorporating a multistage gear machine of the above described type in the thermodynamic system. Owing to its simple construction, based on conventional, cylindrical spur gears, such a machine can be made very compact and at low costs, even with a considerable number of stages.

It is customary in multistage compressors (and expanders) to use a more or less constant pressure ratio in the different stages, i.e. $P_1/P_o=P_2/P_1 \ldots$ etc. This is close to the energy optimum. The same rule can be applied for gear machines, but frequently it may be expedient to distribute the pressure lift differently with a view to adapt to a particular process pattern. The choice of the number of stages must depend primarily on a reasonable balance of investment and energy efficiency. The larger the number of stages, the better the efficiency and the more expensive the system. A sample calculation of a simple compression process can serve to illustrate the situation:

Let us assume that we are compressing air (adiabatic exponent $K=1.4$) from 1 to 5 bar ($P1/Po=5$). By a reversible adiabatic process in a single stage (normal compressor) the theoretical power consumption per kg gas at 20° C. entry temperature ($V_o=0.8409\ m^3/kg$) will be $$W_{ad} = \frac{K}{K-1} p_o v_o \left[ \left( \frac{p}{p_o} \right)^{\frac{K-1}{K}} - 1 \right] = 171.8 \text{ kJ/kg}$$

If on the other hand it had been possible to realize an ideal isothermal process, the corresponding power requirement would have been $$W_{is} = p_o \cdot v_o \ln \frac{p}{p_o} = 135.3 \text{ kJ/kg}$$

with a step-wise compression in five stages, which seems reasonable for a gear machine for the given conditions, the pressure ratio per stage could be $\pi=5/\sqrt{5}=1.38$ and the corresponding theoretical power would be $$W_5=5\ (\pi-1)\ p_o v_o=159.7 \text{ kJ/kg}$$

This is considerably less than for the conventional single stage adiabatic machine, but of course higher than for the ideal isothermal process.

If the cheapest possible machine is wanted, a lower number of stages n should be chosen. A larger number will improve the efficiency within a reasonable limit at some extra expense. The following table can give an indication of how the power requirement per kg gas varies with n for the same conditions. It is clear that an increase beyond n=5 gives only a very limited improvement in the present case. At increasing n the effect of friction losses will also have to be considered.

| n | 3 | 5 | 7 |
|---|---|---|---|
| $W_N$kJ/kg | 179.1 | 159.7 | 152.2 |

Figure 5:
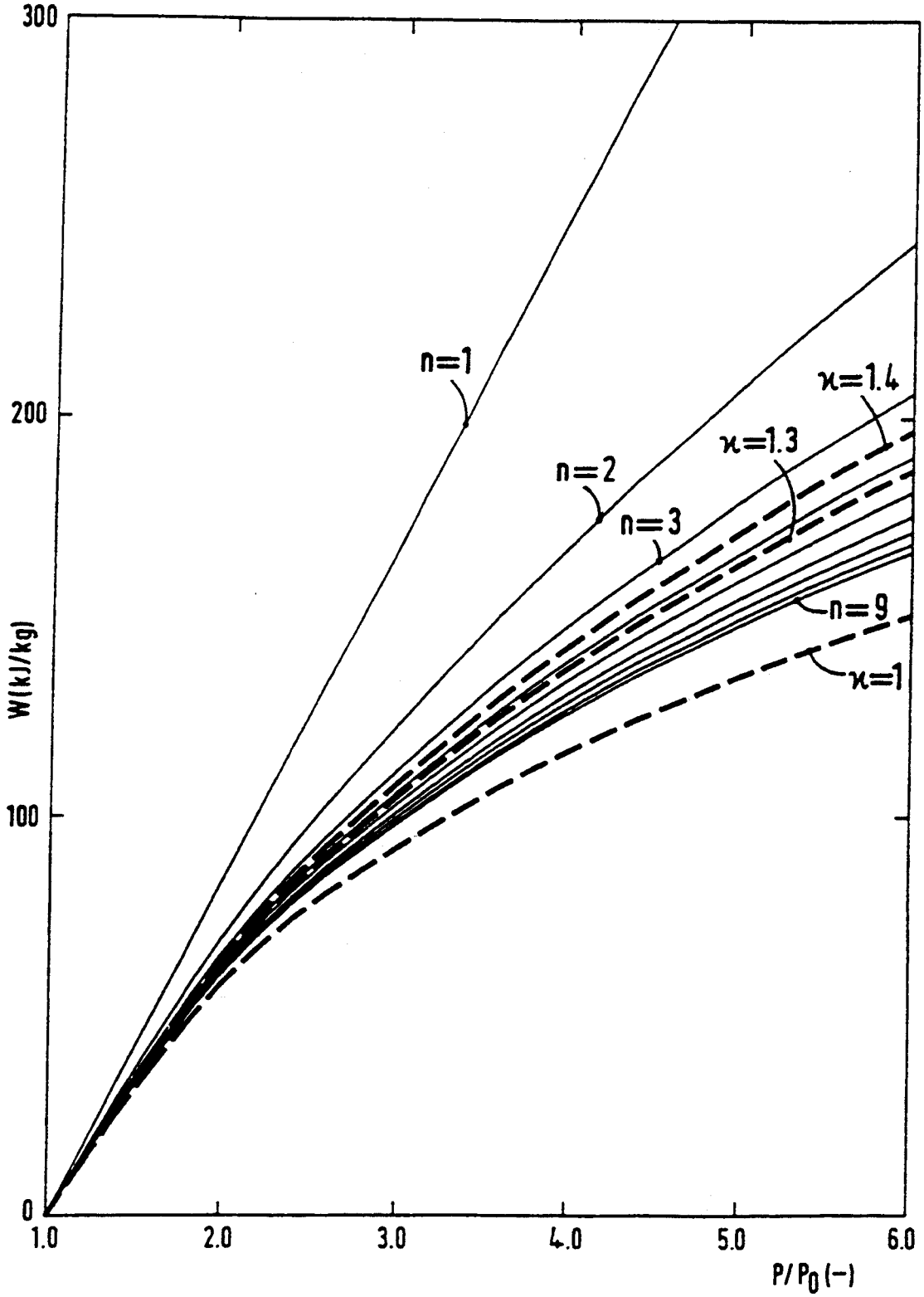
FIG. 5 is a diagram illustrating the influence of the number of stages on the theoretical energy consumption.

The same relationship is shown in greater detail in FIG. 5, indicating how the number of stages n influences the theoretical power requirement W at varying overall pressure ratio P/Po. A comparison of the different processes is also shown in the PV diagram FIG. 4 (for four stages) where the theoretical power is represented by the area enclosed by the trace of the process in question.

Figure 6A:
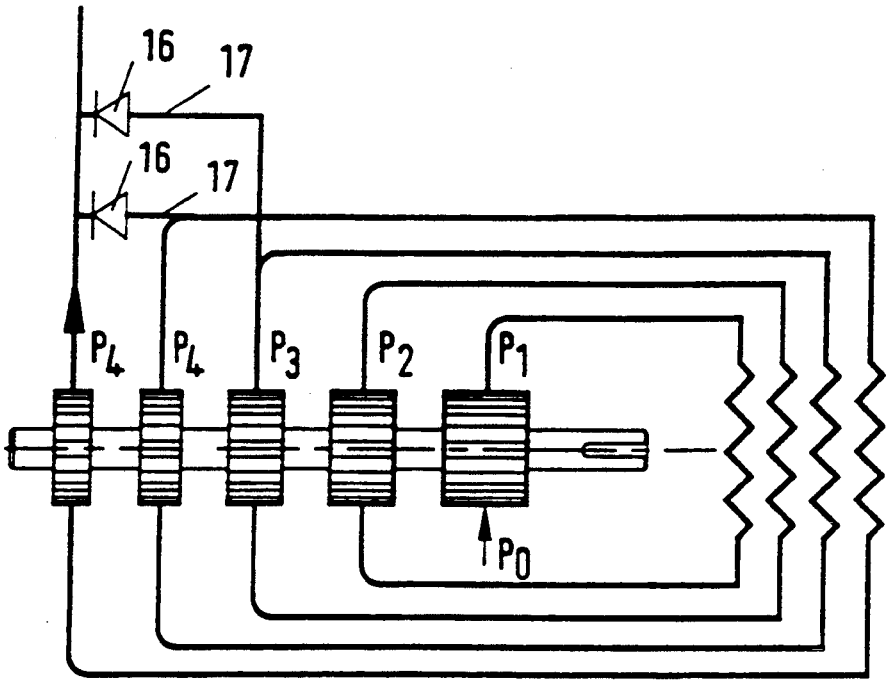
FIG. 6*a* is a flow diagram like FIG. 3 showing a detail of an advantageous embodiment of the invention.
Figure 6B:
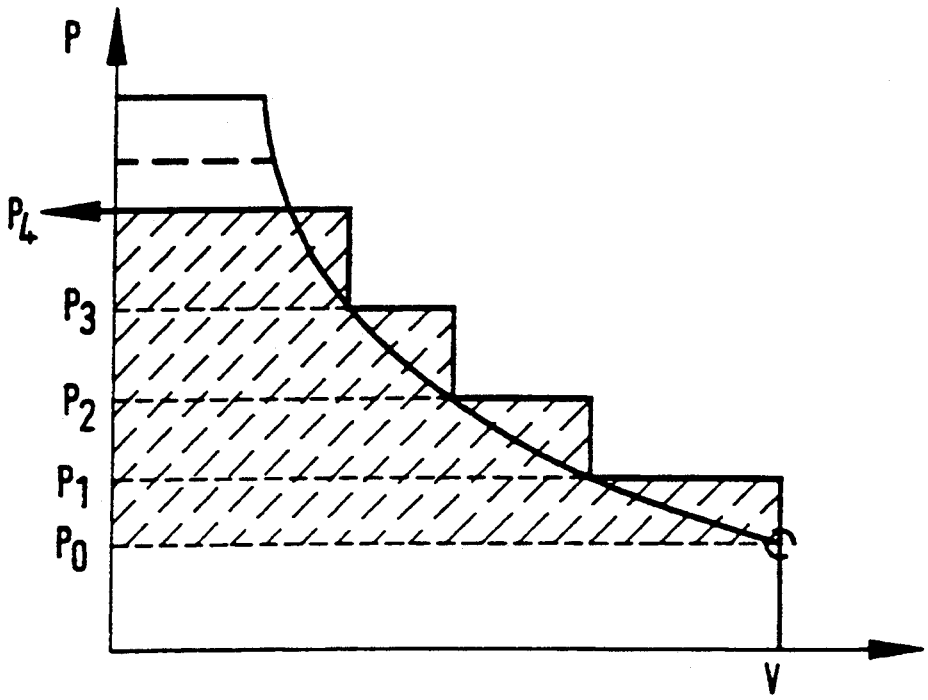
FIG. 6*b* is a PV diagram showing the compression curve using the embodiment of FIG. 6*a*, FIGS. 7*a* and 7*b* are a system and T-s diagram respectively illustrating a typical prior art heat pump.

At a given volume ratio of the various stages their pressure ratio is also decided, independently of the overall pressure lift. The last stage will automatically adjust its pressure to fit the delivery, however, while the other stages remain unaffected. In order to avoid overcompression in cases when the discharge pressure can fluctuate more than the last stage can absorb, the last but one (or possibly the two or three last but one stages) can be fitted with a special relief check valve 16 and bypass to outlet 17, as indicated schematically in FIG. 6*a* for a compressor of five stages raising the pressure from $P_o$ to $P_4$. By this device, the part of the compressor which would otherwise work with an excess pressure, will be unloaded. The corresponding PV diagram under these conditions appears in FIG. 6*b*. This represents a further advantage over the normal rotary compressors with continuous displacement and a built-in constant volume ratio. The number of stages must always be sufficient for the compressor to manage the maximum overall pressure lift to which it will be exposed.

A multistage gear machine can, as already mentioned, be used equally well as an expander with or without interheating. The high pressure gas is supplied to the set of gears with the smallest transport volume and made to pass successively through stages of increasing flow capacity. The last stage will automatically adjust to a change of the back-pressure within its range capability. When large variations have to be coped with, it will be expedient to equip the last but one and possible more stages with check-valve(s) opening in directions into the machine and connection(s) to the outlet. These will function in a similar way as described above for the compressor and prevent over-expansion at reduced pressure ratio.

A multistage gear machine can be applied equally well to compression and expansion. By interstage heating between stages an isothermal expansion process can be approached, or for that matter adapted to another desired gliding temperature variation. This may be useful for instance in designing thermal power processes.

As an example of using the principles according to the invention in designing a suitable thermodynamic process, we can take a heat pump for raising the temperature in a finite flow of liquid or gas from temperature $t_1$ to $t_2$. The heat pump takes low temperature ambient heat (at $T_o$).

Figure 7A:
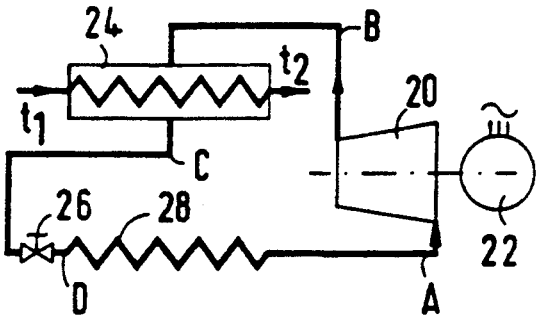
Fig.7a PRIOR ART
Figure 7B:
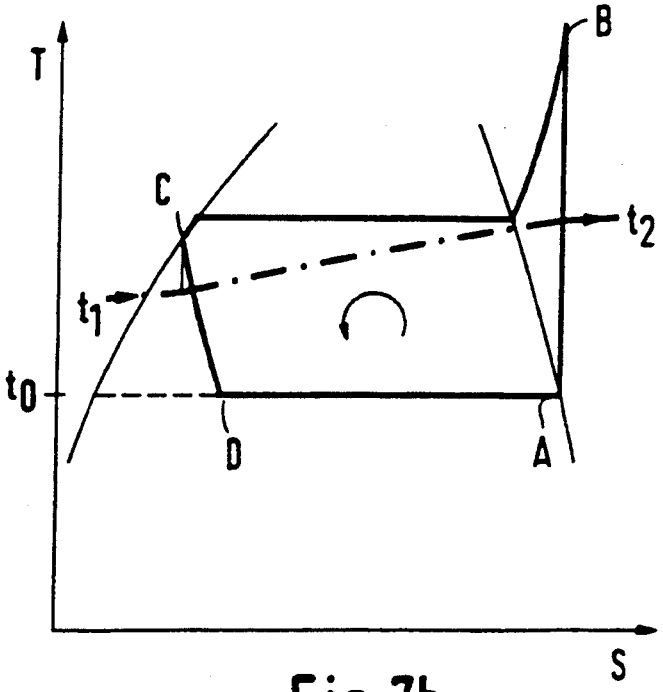
Fig.7b PRIOR ART

A schematic system diagram and temperature/entropy (T-s) chart for the normal, prior art process of a compression heat pump, using an evaporating and condensing working fluid, is shown in FIGS. 7*a* and 7*b* respectively. A single stage conventional compressor 20, e.g. of the reciprocating or rotary type and driven by a motor 22, draws or sucks in gas in a saturated or slightly superheated state A and compresses it in a single stage to the considerably superheated state B. The gas is then cooled and condensed at a near constant temperature and pressure in a condensor 24 to a state C of slightly subcooled liquid. The fluid is then irreversibly throttled in an expansion valve 26 and supplied to an evaporator 28 in state D. After evaporation in evaporator 28 by absorption of ambient heat the gas is again supplied to the compressor 20 in state A. As appearing from the T-s chart of FIG. 7*b*, the heat transfer to the fluid to be heated from $t_1$ to $t_2$ takes place with a considerable temperature difference, causing an important loss of power, which means a low efficiency process.

Figure 8A:
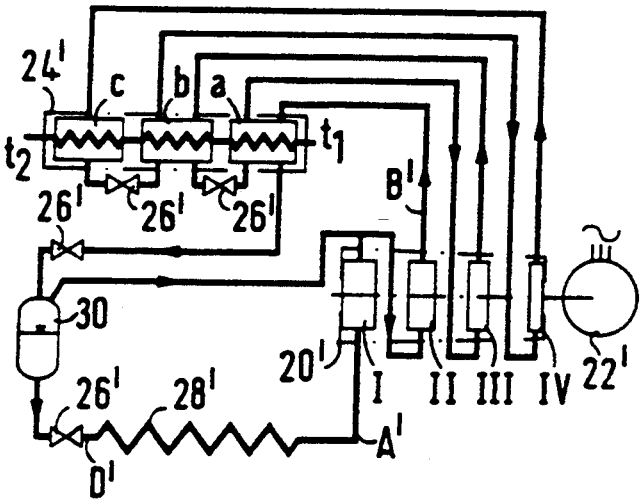
FIGS. 8*a* and 8*b* are similar diagrams showing a heat pump system according to the invention.
Figure 8B:
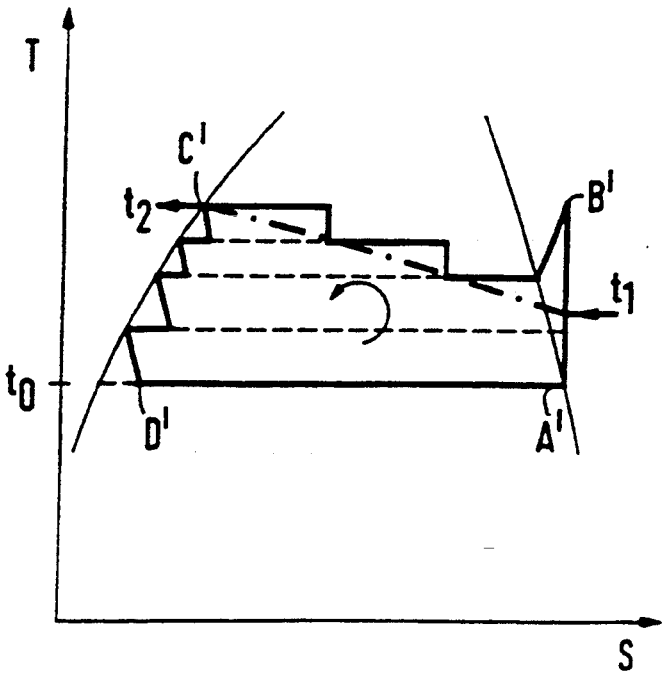

An alternative system according to the invention is illustrated in FIGS. 8*a* and 8*b*, again being a schematic system diagram and T-s chart respectively. Gas from evaporator 28' at state A' is drawn or sucked into the first stage of a four stage gear compressor 20' driven by motor 22'. After a first compression in two stages I and II it is cooled from state B' and partly condensed in a first section "a" of the condensor 24'. After separation of the liquid in liquid/gas separator 30 the remaining gas is further compressed in the next compressor stage III and partly condensed in a second section "b" and third section "c" of condensor 24' until the fluid is completely liquified in state C'. It is then throttled in four stages through expansion valves 26', and flashgas from each stage is supplied to the appropriate compressor stage in state D'. It is seen from the T-s chart of FIG. 8*b* how the temperature loss to the fluid being heated from $t_1$ to $t_2$ is reduced by this procedure, resulting in a reduction of the theoretical power consumption. The efficiency is also further improved by the multistage throttling and recompression.

Figure 9A:
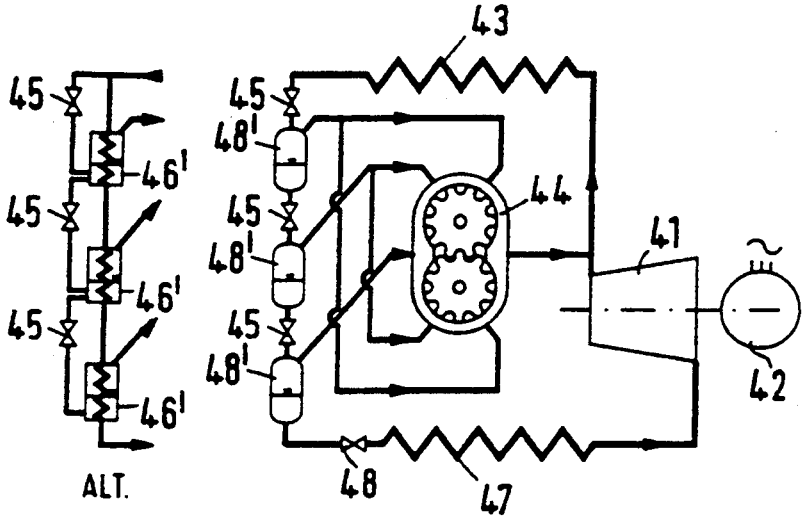
FIGS. 9*a*, 9*b* and 9*c* are system, T-s and PV diagrams respectively illustrating another example of a heat pump or refrigeration system based on the principles of the present invention.
Figure 9B:
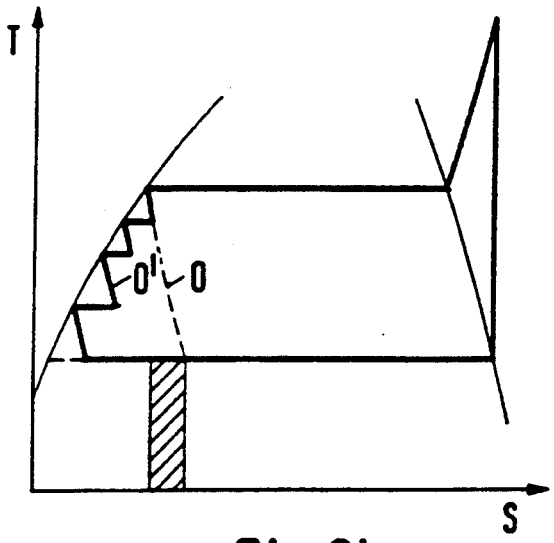
Figure 9C:
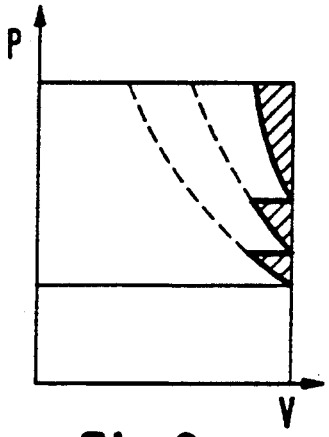

Another application of the principles according to the invention, involving a special expansion aggregate to reduce the throttling loss and thereby improve the efficiency of a normal refrigeration or heat pump plant, is illustrated in FIGS. 9*a–c*. In a normal prior art system the gas coming from an evaporator 47 is compressed in a conventional compressor 41 driven by motor 42, condensed in a condensor 43 and, (through a line not indicated in the drawing) throttled back to the evaporator 47 through a single expansion valve 48. This gives a throttling line as indicated by 0 in the T-s chart FIG. 9*b*, leading to a loss of power as shown by hatching and a loss of refrigeration capacity of the same magnitude.

Now, according to the present invention, for the purpose of reducing these losses, an expansion aggregate consisting of a series of throttling valves 45 and liquid/gas separators in combination with a gear compressor 44 can be employed. The gas formed in each throttling is conveyed to this machine and recompressed to the condensation pressure. By this device the throttling curve in the T-s chart of FIG. 9*b* takes the shape as indicated by 0' and power and capacity losses are dramatically reduced. Two alternative forms of the liquid gas separators are shown in the system diagram of FIG. 9*a*. In the principal case the liquid is cooled successively by direct flashing into the separators 48'. In the alternative system the liquid cooling is done by special heat exchanges 46'. The thermodynamic effect is practically the same. By increasing the number of throttling and recompression stages, the theoretical loss can be reduced as much as desired.

Figure 10:
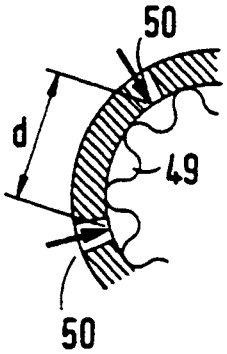
FIG. 10 is a part sectional view of a gear machine.

Instead of using a normal multistage compressor with a corresponding number of cooperating gears (e.g. of the type shown in FIG. 1), it may be expedient in this particular case to use a machine with only one or a limited number of sets of gears and increase the number of pressure stages by providing inlet openings or gates 50 between the regular suction and discharge, as indicated schematically in FIG. 10. Gas from the lowest pressure is sucked in through the regular suction gate (not shown) in the normal way, while that from successively higher pressure is injected to the intertooth spaces 49 when they are closed off in passage from suction to discharge. These extra suction openings 50 must obviously be spaced at a peripheral center distance "d" not less than the width of the tooth space 49 plus the width of the gate 50 itself. This limits the number of extra gates 50 which can be accommodated for each set of gears. A similar arrangement may be used in connection with gear compressors which are primarily applied for other purposes.

The described procedure leads to a rigid relation between the interstage pressure as defined by the requirement of a constant product of mass and specific volume in the constant volume intertooth space. Normally this leads to very reasonable pressure increments. The corresponding PV diagram of FIG. 9*c* shows how the loss by lack of progressive displacement of the gear machine is reduced by this system (shown by hatching in the diagram). This opens the possibility to use gear machines efficiently at higher pressure ratios.

An expansion aggregate in accordance with the described principles is a very rational design for inclusion in conventional refrigeration and heat pump systems, also as retrofit, and should be considered part of the present invention.

Yet another example refers to a transcritical process for a refrigeration or heat pump plant. The choice of suitable working media for such applications is limited and the use of transcritical systems will widen the selection and give some other advantages in special cases.

Figure 11A:
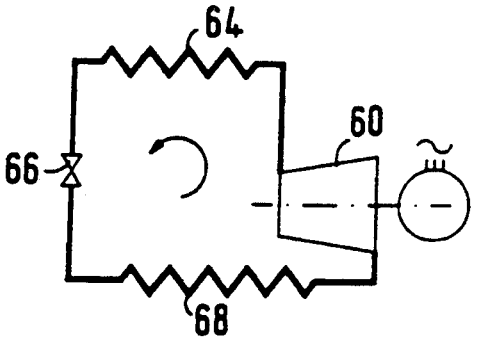
Fig.11a PRIOR ART
FIGS. 11*a* and 11*b* are system and T-s diagrams respectively of another typical prior art trans-critical heat pump or refrigeration plant.
Figure 11B:
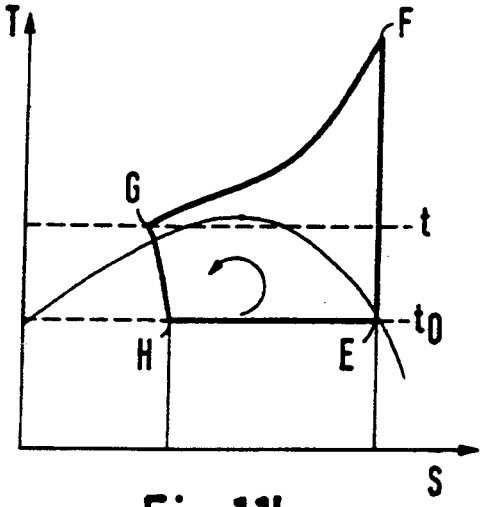
Fig.11b PRIOR ART

FIGS. 11*a* and 11*b* illustrate a conventional transcritical process by a system diagram and by a temperature/entropy (T-s) chart, respectively. Gas in a near saturated or slightly superheated state E is sucked into compressor 60 and discharged at super-critical pressure and relatively high temperature, state F. After cooling to near ambient temperature in a heat exchanger or cooler 64, state G, the gas is throttled in an expansion valve 66 and injected as a mixture of liquid and gas (state H) into an evaporator 68. After evaporation it is again fed to the compressor 60 in state E. When heat is given off (process F–G) to a fluid of more or less constant temperature, for instance ambient, there is a very considerable loss by the irreversible heat exchange in cooler 64. Also the single stage throttling causes an important loss of power and refrigeration capacity.

Figure 12A:
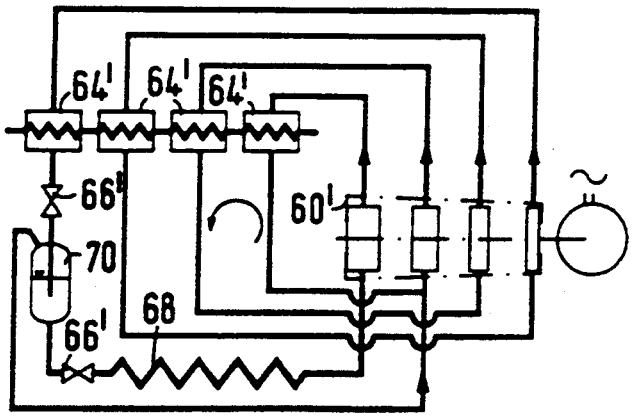
FIGS. 12*a* and 12*b* are similar diagrams of a corresponding system according to the invention.
Figure 12B:
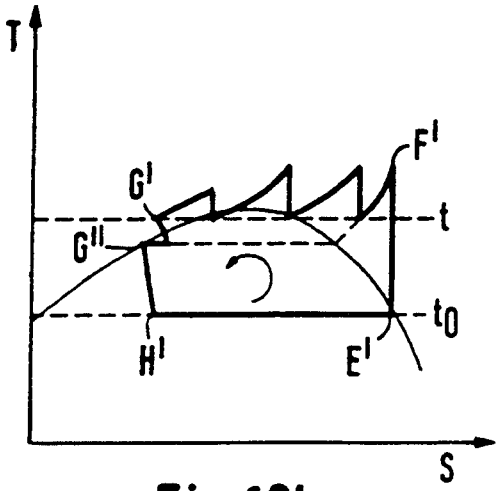

A system to considerably reduce these drawbacks, using the principles according to the present invention, is illustrated in a system flow diagram of FIG. 12*a* and a T-s chart of FIG. 12*b*, using a four stage gear compressor 60'. Again the gas from the evaporator 68 is sucked into the first stage of the compressor 60 at state E' and compressed in four steps with intercooling in coolers 64'. The high pressure gas at state G' is then throttled in expansion valve 66' to an intermediate pressure and injected into a gas/liquid separator 70. The gas fraction is supplied to the second stage of the compressor while the remaining liquid at state H is further throttled to the evaporator pressure through another valve 66' to reach state H'. After evaporation it is again supplied to the compressor 60' in state E. It is also possible to use additional throttling stages in accordance with the principles as described in connection with FIGS. 8*a* and 8*b*.

The advantage in reducing the theoretical power requirement is apparent by comparing the T-s diagrams of FIGS. 11*b* and 12*b*. A constant temperature of heat rejection t was assumed. It is, however, possible to adapt the process to any desired temperature.

Since most of the available working media have a critical point between 30 and 50 bar, transcritical operation may also be desirable with a view to reduce the pumping volume. It also has an interesting advantage in improved heat exchange.

The principle as explained above and illustrated by examples of application, will show how it is possible to approach any desired thermodynamic cycle with a closer match than obtainable with normal systems used today. Application of multistage gear machines in combination with interstage heat exchangers offers much increased flexibility towards this aim.

Figure 13A:
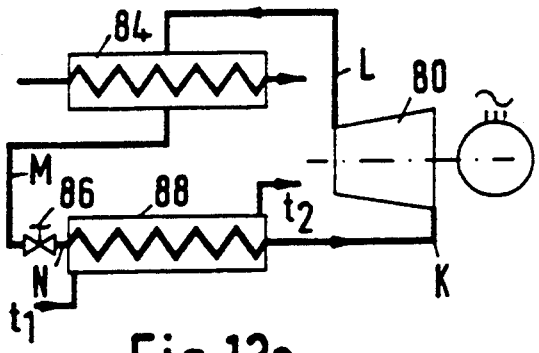
Fig.13a PRIOR ART
FIGS. 13*a*, 13*b* and 14*a*, 14*b* are diagrams illustrating yet another comparative example of a prior system versus a system according to the present invention.
Figure 13B:
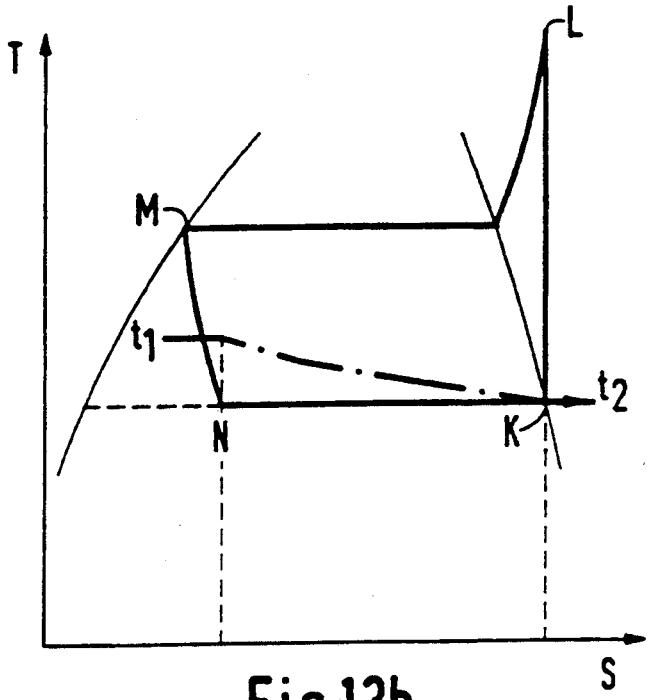
Fig.13b PRIOR ART

Multistage gear expanders can be used to achieve an approach to a theoretical gliding temperature process in a very similar way as described for the compressor in previous examples. FIGS. 13*a* and 13*b* show a system diagram and T-s chart respectively for a refrigeration plant according to conventional technology, cooling a fluid flow from temperature $t_1$ to $t_2$. The working fluid is compressed in a conventional compressor 80 from state K to state L, cooled and condensed to state M in a condensor 84, throttled to the evaporator pressure in expansion valve 86 and injected into an evaporator 88 in state N. After evaporation by absorption of the refrigeration load it is returned to the compressor in a near saturated or slightly superheated condition, state K. The process exhibits two important thermodynamic losses, by the single stage throttling M-N and by irreversible heat exchange N-K.

Figure 14A:
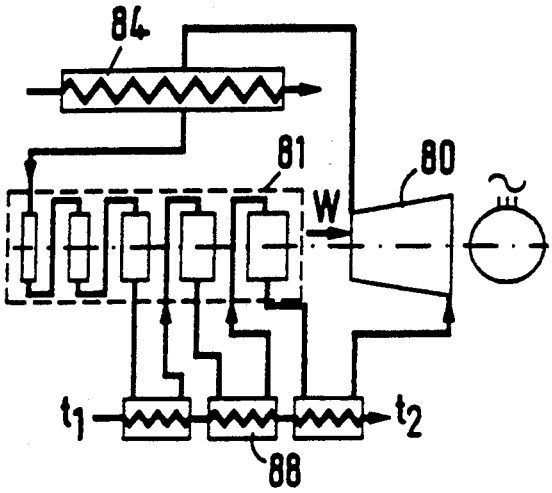
Figure 14B:
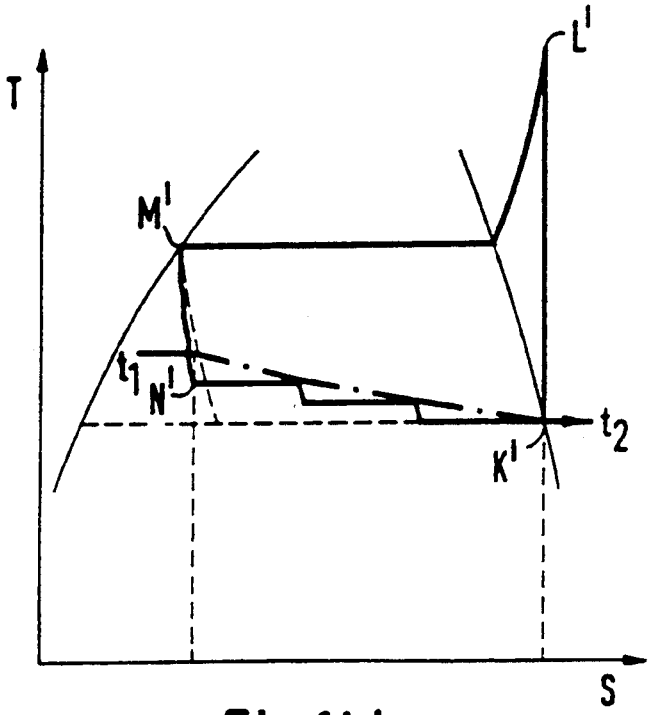

The process can be modified to reduce these losses by using a multistage, e.g. five stage gear expander 81 according to the invention as indicated in corresponding diagrams of FIGS. 14*a* and 14*b*. The compressor 80 and condensor 84 are left unchanged from the conventional system, although a multistage gear compressor could have been used to advantage as previously exemplified. The multistage gear expander 81, which essentially could be similar to the gear machine 1 illustrated in FIGS. 1 and 2, is used to give a better approach to a more ideal theoretical process of step-wise expansion and evaporation as illustrated in the T-s chart of FIG. 14*b*. Liquid from the condensor 84 at state M is supplied to the first stage of the expander 81 and two succeeding stages to reach a partly expanded stage N', while the two final expander stages cooperate with a multisection evaporator 88 working with a mixture of gas and liquid. Since the power produced by the first (liquid) stage is quite small, it may be more practical to replace this with a simple throttling valve. This would simplify the flow regulation in the system. The power generated in the expander 81 may be used to reduce the external driving power for the compressor as indicated schematically in FIG. 14*a*.

There are many ways in which the application of multistage gear machines can be combined to improve thermodynamic processes, and only some typical cases are shown in the examples herein. Frequently it is a matter of choice whether to use a compressor or an expander to generate an approach to a gliding temperature, for instance. In some cases it is possible to combine expansion and compression in different gear pairs in the same machine, thus creating a self-contained aggregate without any need of external exchange of power.

I claim:

1. A closed cycle thermodynamic system comprising:

a multistage compressor/expander including plural stages, whereby a working fluid circulating through said system is passed through said stages sequentially such that the working fluid is compressed/expanded sequentially from a first said stage to a last said stage;

each said stage comprising a respective pair of meshing gears of power-transmitting type, and each said stage having a main inlet for introduction of working fluid and a main outlet for discharge of working fluid; and at least one sequentially adjacent pair of said stages having therebetween an interstage fluid conditioning means for causing temperature variation/phase transition of working fluid passing between said pair of stages, said interstage fluid conditioning means being connected between said main outlet of an upstream stage of said pair of stages and said main inlet of a downstream stage of said pair of stages, such that working fluid compressed/expanded by said upstream stage is conditioned by said interstage fluid conditioning means before being compressed/expanded by said downstream stage.

2. A system as claimed in claim 1, comprising a plurality of interstage fluid conditioning means each disposed between a respective adjacent pair of said stages.

3. A system as claimed in claim 2, wherein each adjacent pair of said stages has disposed therebetween a respective said interstage fluid conditioning means.

4. A system as claimed in claim 1, wherein said main outlet of a said stage before said last stage is provided with a relief valve to bypass said last stage.

5. A system as claimed in claim 1, wherein said main outlet of a said stage before said last stage is provided with a check valve to vent working fluid to a preceding stage.

6. A system as claimed in claim 1, wherein at least one said stage has additional inlets for introducing working fluid into intertooth spaces located between said main inlet and said main outlet of said stage.

7. A system as claimed in claim 1, wherein said interstage fluid conditioning means comprise heat exchanger means, evaporator means or condenser means.

8. A system as claimed in claim 7, wherein said interstage fluid conditioning means further comprise liquid separator means, mass exchange means or throttling means.

9. A system as claimed in claim 1, comprising a heat pump.

10. A system as claimed in claim 1, comprising a refrigerator.

11. A system as claimed in claim 1, wherein said gears comprise cylindrical spur gears.

12. A system as claimed in claim 1, wherein said gears of all said stages are equal in diameter, and said gears decrease in width from said first stage to said last stage.

13. A system as claimed in claim 1, wherein said main inlet and said main outlet of each said stage are directed laterally of axes of the respective said gears thereof.

* * * * *